US011878951B2

(12) United States Patent
Fronabarger et al.

(10) Patent No.: US 11,878,951 B2
(45) Date of Patent: Jan. 23, 2024

(54) NON-CONDUCTIVE PYROTECHNIC MIXTURE

(71) Applicant: Pacific Scientific Energetic Materials Company, Chandler, AZ (US)

(72) Inventors: John W. Fronabarger, Sun Lakes, AZ (US); Jason B. Pattison, Phoenix, AZ (US); Robert Holderman, Crestview, FL (US)

(73) Assignee: PACIFIC SCIENTIFIC ENERGETIC MATERIALS COMPANY, Chandler, AZ (US)

( * ) Notice: Subject to any disclaimer, the term of this patent is extended or adjusted under 35 U.S.C. 154(b) by 1163 days.

(21) Appl. No.: 16/248,961

(22) Filed: Jan. 16, 2019

(65) Prior Publication Data

US 2020/0223766 A1 Jul. 16, 2020

(51) Int. Cl.

| | |
|---|---|
| ***C06B 43/00*** | (2006.01) |
| ***C06B 29/02*** | (2006.01) |
| ***F42B 3/12*** | (2006.01) |

(52) U.S. Cl.

CPC ..... *C06B 43/00* (2013.01); *C06B 29/02* (2013.01); *F42B 3/128* (2013.01)

(58) Field of Classification Search

None

See application file for complete search history.

(56) References Cited

U.S. PATENT DOCUMENTS

| | | | | |
|---|---|---|---|---|
| 3,793,100 | A | 2/1974 | Fronabarger | |
| 4,370,181 | A * | 1/1983 | Lundstrom | C01B 21/02 264/3.4 |
| 5,053,086 | A | 10/1991 | Henry et al. | |
| 6,045,637 | A | 4/2000 | Grzyll | |
| 6,136,114 | A * | 10/2000 | Johnson | C06B 23/007 149/22 |
| 6,214,139 | B1 | 4/2001 | Hiskey et al. | |
| 6,689,237 | B1 | 2/2004 | Mendenhall | |
| 2001/0042577 | A1 | 11/2001 | Redecker et al. | |

(Continued)

OTHER PUBLICATIONS

Zhang et al., "Crystal Structure and Properties of a Novel Green Initiation Explosive Dipotassium, 5,5'-bis(tetrazole-1-oxide)", Chinese Journal of Energetic Materials, vol. 24, Dec. 24, 2016, pp. 1173-1177—English abstract submitted.

(Continued)

*Primary Examiner* — Aileen B Felton

(74) *Attorney, Agent, or Firm* — Kilpatrick Townsend & Stockton LLP

(57) ABSTRACT

Described are energetic compositions formed of a 5,5'-bistetrazole salt and a perchlorate salt, in which the energetic composition is a co-precipitated product. The 5,5'-bistetrazole salt and the perchlorate salt can be dipotassium 5,5'-bistetrazole and potassium perchlorate. The energetic composition can have a particle size distribution between 1-50

(Continued)

micron and/or a mean volume diameter of less than 30 micron. In a low energy electro-explosive device, an ignition element is at least partially surrounded by an acceptor formed of this energetic composition, and the ignition element can be a bridgewire, a thin film bridge, a semiconductor bridge, or a reactive semiconductor bridge.

10 Claims, 2 Drawing Sheets

(56) References Cited

U.S. PATENT DOCUMENTS

| | | | | |
|---|---|---|---|---|
| 2003/0024618 | A1* | 2/2003 | Wu | C06D 5/06 149/19.7 |
| 2013/0153098 | A1* | 6/2013 | Ganta | C06D 5/06 149/55 |
| 2015/0239792 | A1* | 8/2015 | Fujisaki | C06B 31/00 149/45 |
| 2015/0353437 | A1 | 12/2015 | Rambow | |
| 2016/0280614 | A1 | 9/2016 | Nesveda | |
| 2017/0008482 | A1* | 1/2017 | Kobayashi | B60R 21/264 |

OTHER PUBLICATIONS

European Patent Application No. EP20150137.6, Extended European Search Report dated Jun. 3, 2020, 8 pages.
European Application No. 20150137.6 , "Office Action", dated Jun. 30, 2023, 5 pages.
Carlson et al., "Development and Application of LEESA (Low Energy Electrostatic Sensitivity Apparatus)", In Proceedings of the 15th International Pyrotechnics Seminar, Jul. 1990, pp. 161-180.
Finger et al., "Synthesis and Characterisation of 5,5'-Bistetrazolate Salts with Alkali Metal, Ammonium and Imidazolium Cations", Z. Anorg. Allg. Chem., vol. 639, No. 7, Jun. 2013, 14 pages.
Fischer et al., "Alkaline Earth Metal Salts of 5,5'-Bistetrazole-from Academical Interest to Practical Application", Z. Anorg. Allg. Chem., vol. 637, No. 12, Aug. 11, 2011, pp. 1693-1701.
Fischer et al., "Energetic Salts of 5,5'-Bis(tetrazole-2-oxide) in a Comparison to 5,5'-Bis(tetrazole-1-oxide) Derivatives", Polyhedron, vol. 51, No. 1, Mar. 4, 2013, pp. 201-210.
Fischer et al., "Pushing the Limits of Energetic Materials—The Synthesis and Characterization of Dihydroxylammonium 5,5'-bistetrazole-1,1'-diolate", Journal of Materials Chemistry, vol. 22, No. 38, Sep. 2012, pp. 20418-20422
Zhang et al., "Crystal Structure and Properties of a Novel Green Initiation Explosive Dipotassium, 5,5'-bis(tetrazole-1-oxide)", Chinese Journal of Energetic Materials, vol. 24, Dec. 24, 2016, pp. 1173-1177—English abstract sumitted.

* cited by examiner

NON-CONDUCTIVE PYROTECHNIC MIXTURE

FIELD OF THE INVENTION

This invention relates to a pyrotechnic mixture, and in particular to a pyrotechnic mixture containing dipotassium 5,5'-bistetrazole and potassium perchlorate for use as an ignition material in electro-explosive devices.

BACKGROUND

The pyrotechnic mixture zirconium/potassium perchlorate ("ZPP") has been widely used in electro-explosive devices ("EED") for many years as a composition that converts the electrical energy applied to a bridgewire into sufficient heat and hot particles to initiate a transfer charge or explosive output. ZPP is widely used in air bag initiators and also finds use in the NASA Standard Initiator ("NSI") where it plays a critical role in initiating various pyrotechnic events in space applications. Due to the demanding nature of these applications, the NSI and, more specifically, the ZPP contained therein have been extensively investigated and the chemical, physical and output properties of various mixtures are well known. Despite being a widely used and effective pyrotechnic, ZPP is electrically conductive due to the zirconium content, which renders it particularly vulnerable to electrostatic discharge ("ESD") and which makes it a safety hazard during handling and loading in ordnance items.

Operations involving ZPP require both assembly personnel and hardware used in manufacturing to be efficiently grounded. Even with safeguards in place, inadvertent ignition of ZPP mixtures are not uncommon. In addition, EEDs containing ZPP require electrostatic protection to protect these devices from unintended initiation. Electrical insulation and external spark gaps are commonly used in EEDs containing ZPP to provide dissipation of any stray electrostatic charge and add manufacturing costs to these devices.

ZPP is typically activated by electrically heating an ignition element, such as a thin metal bridgewire, lying at the bottom of a charge cup fabricated from alumina or similar insulating material. Energy transfer from the resistive wire to the ZPP charge causes it to ignite, initiating a chemical chain reaction that results in an output of heat, flame and sparks. Under the right conditions, however; ZPP can meet the 1 amp/1 watt/5 minute no-fire safety requirement imposed by U.S. military design specifications (e.g., MIL-I-23659). This is partially due to the high thermal conductivity of ZPP mixtures that effectively move heat away from the bridgewire and into the bulk material under no-fire conditions. Other ignition elements that may be utilized to initiate EEDs include thin film bridges, semiconductor bridges and reactive semiconductor bridges, and these may be used in place of the typical hot wire described as the ignition element. Advantages of these other ignition elements include enhanced ability to dissipate heat to meet no-fire requirements and the capability to initiate energetic materials other than pyrotechnics.

One issue with metal-based pyrotechnics like ZPP is the potential for post-combustion residue to be conductive, which may impact the lifetime of batteries or other energy sources used during the ignition process. In more recent component design, this issue is mitigated using electronic schemes that isolate the component after ignition, but the issue remains in some legacy initiators.

A potential replacement for pyrotechnics such as ZPP may be a mixture of dipotassium 5,5'-bistetrazole ("$K_2Tz_2$") and potassium perchlorate ("KP"). This mixture of energetic fuel and oxidizer, in optimized ratio, may provide an output similar to other pyrotechnic systems, but would have the benefit of being non-conductive both prior to and after ignition as well as being stable at very high temperatures. Specifically, the material demonstrates a temperature capability of over 400° C., which is unexpected for organic materials and is a very desirable property for low energy EED applications.

Derivatives of 5,5'-bistetrazole are widely used as explosives and in gas generating compositions. See Fischer, N., Fischer, D., Klapötke, T., Piercey, D. and Stierstorfer, J., "Pushing the limits of energetic materials—The synthesis and characterization of dihydroxylammonium 5,5'-bistetrazole-1,1'-diolate". *Journal of Materials Chemistry,* 22, 20418-20422 (2012); Fischer, N., Gao, L., Klapoetke, T., and Stierstorfer, J., "Energetic salts of 5,5'-bis(tetrazole-2-oxide) in a comparison to 5,5'-bis(tetrazole-1-oxide) derivatives". *Polyhedron,* 51, 201-210 (2013); and Zhang, Z., Yin, L., Li, T., Yin, X. and Zhang, J., "Crystal structure and properties of a novel green initiation explosive dipotassium, 5,5'-bis(tetrazole-1-oxide). *Chinese Journal of Energetic Materials,* 24, 1173-1177 (2016).

Likewise, salts of 5,5'-bistetrazole are widely used as explosives and in gas generating compositions. See U.S. Pat. Nos. 4,370,181; 5,053,086; 6,045,637; and 6,689,237; and Fischer, N., Klapötke, T. M., Peters, K. , Rusan, M. and Stierstorfer, J., "Alkaline Earth Metal Salts of 5,5'-Bistetrazole—from Academical Interest to Practical Application". *Z. anorg. allg. Chem.,* 637: 1693-1701 (2011).

Furthermore, the dipotassium salt of 5,5'-bistetrazole has been prepared. See Finger, L. H., Schröder, F. G. and Sundermeyer, J. "Synthesis and Characterisation of 5,5'-Bistetrazolate Salts with Alkali Metal, Ammonium and Imidazolium Cations". *Z. anorg. allg. Chem.,* 639: 1140-1152 (2013).

To date, these bistetrazole salts have been prepared using a single salt mechanical mixing system, in which the ingredients must be milled to a precise particle size prior to forming the composition as a means of achieving a more homogeneous product. Otherwise, the variation in particle size often results in variation in performance, which is not ideal for ignition agents or primers. Thus, it is desirable to produce a 5,5'-bistetrazole salt material in a highly homogenous form without the need for pre-milling the ingredients.

In the 1970s, as described in U.S. Pat. No. 3,793,100, a method was developed that eliminated the need to pre-mill the ingredients to achieve a highly homogeneous product by producing a co-precipitated material for use in hot wire and rapid deflagrating cord ("RDC") applications. Unfortunately, the method was developed for use with complex metal cyanides as the fuel source, which had corrosion issues when used in applications with bridgewires or other metals. As a result, further development or adoption of the method for use in hot wire applications was not pursued.

The 5,5'-bistetrazole are ideal candidates for hot wire or RDC applications, which require a non-corrosive and homogeneous energetic material with a very predictable high temperature stability and low ESD sensitivity to avoid unintended ignition of the material. Thus, embodiments of the present invention involve producing a co-precipitated 5,5'-bistetrazole salt and perchlorate salt composition for use with ignition elements in low energy EED applications, such as bridgewires, thin film bridges, semiconductor bridges, and reactive semiconductor bridges.

SUMMARY

According to certain embodiments of the present invention, an energetic composition comprises a 5,5'-bistetrazole salt and a perchlorate salt. In some embodiments, the energetic composition is a co-precipitated product. In these or other embodiments, a particle size distribution of the energetic composition may range between 1-50 micron and/or may comprise a mean volume diameter of less than 30 micron. In further embodiments, the 5,5'-bistetrazole salt and the perchlorate salt are dipotassium 5,5'-bistetrazole and potassium perchlorate, wherein the 5,5'-bistetrazole salt may be at least 0.8 mole per mole of perchlorate salt.

According to additional embodiments of the present invention, a low energy electro-explosive device comprises an ignition element and an acceptor surrounding at least a portion of the ignition element and comprising a 5,5'-bistetrazole salt and a perchlorate salt. In some embodiments, the ignition element is a bridgewire, a thin film bridge, a semiconductor bridge, or a reactive semiconductor bridge. In these or other embodiments, the 5,5'-bistetrazole salt and the perchlorate salt is a co-precipitated product. In certain embodiments, a particle size distribution of the 5,5'-bistetrazole salt and the perchlorate salt may range between 1-50 micron and/or may comprise a mean volume diameter of less than 30 micron. In further embodiments, the 5,5'-bistetrazole salt and the perchlorate salt are dipotassium 5,5'-bistetrazole and potassium perchlorate, wherein the 5,5'-bistetrazole salt may be at least 0.8 mole per mole of perchlorate salt.

According to additional embodiments of the present invention, a method for preparing an energetic composition comprising a 5,5'-bistetrazole salt and a perchlorate salt, comprises the steps of (a) providing an aqueous solution of 5,5'-bistetrazole salt and a perchlorate salt; (b) heating the aqueous solution to a temperature where the salts are fully dissolved; (c) adding the aqueous solution to a non-solvent to induce precipitation; and (d) isolating the precipitated solid. In some embodiments, the aqueous solution is heated to at least 50° C. In further embodiments, the 5,5'-bistetrazole salt and the perchlorate salt are dipotassium 5,5'-bistetrazole and potassium perchlorate, wherein the 5,5'-bistetrazole salt may be at least 0.8 mole per mole of perchlorate salt. In further embodiments, the non-solvent is 2-propanol.

According to additional embodiments of the present invention, a reaction product is formed by (a) mixing a 5,5'-bistetrazole salt, a perchlorate salt, and water or other suitable solvent to form a solution; (b) heating the solution to fully dissolve the solids; (c) adding the solution to a non-solvent to induce precipitation; and (d) isolating the precipitated solid. In these or other embodiments, the reaction product is characterized by a Differential Scanning Calorimetry curve substantially as shown in FIG. 1 and/or by a Fourier Transform Infrared Spectroscopy spectra as shown in FIG. 2.

DETAILED DESCRIPTION

One aspect of the present subject matter is preparation of the dipotassium 5,5'-bistetrazole/potassium perchlorate composition ("BI-820").

Methods for preparing BI-820 are contemplated in the present application. BI-820 may be prepared by dissolving $K_2Tz_2$ and KP in aqueous solution at 85° C. and then co-precipitating the materials by addition to cooled 2-propanol. On addition, the BI-820 precipitates and may be recovered by filtration. The BI-820 product may be washed with suitable 2-propanol and either air or oven dried.

Figure 1:
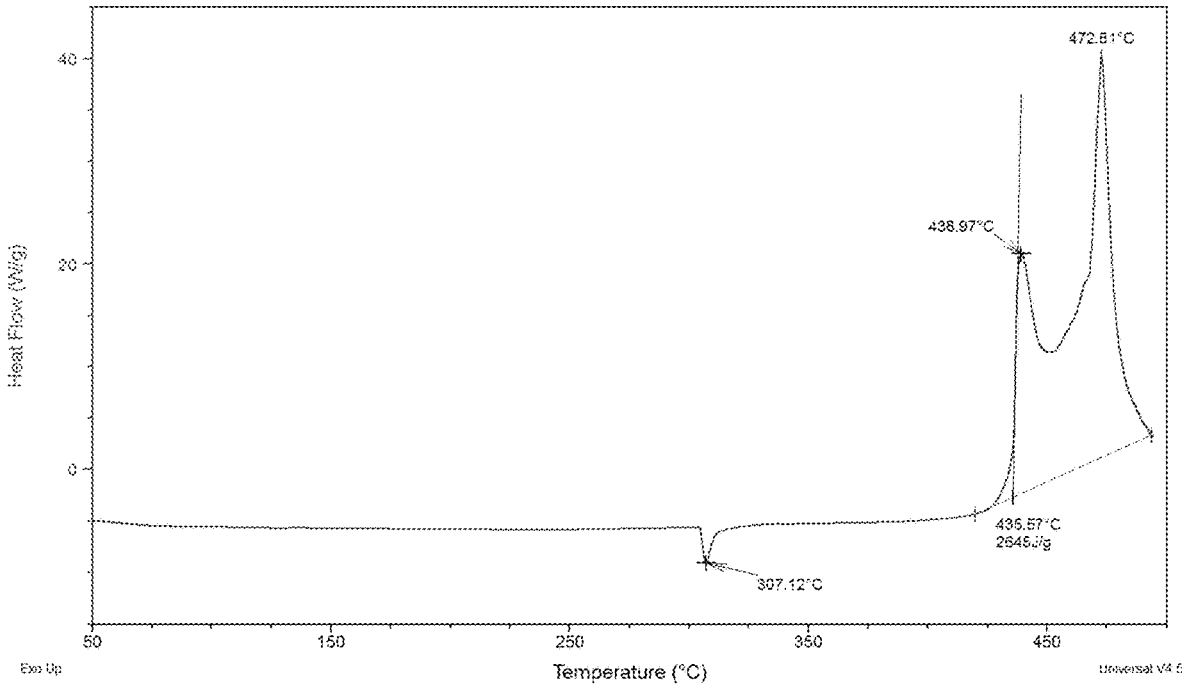
FIG. 1 shows the results of a differential scanning calorimetry ("DSC") analysis on a material prepared according to the present techniques.
Figure 2:
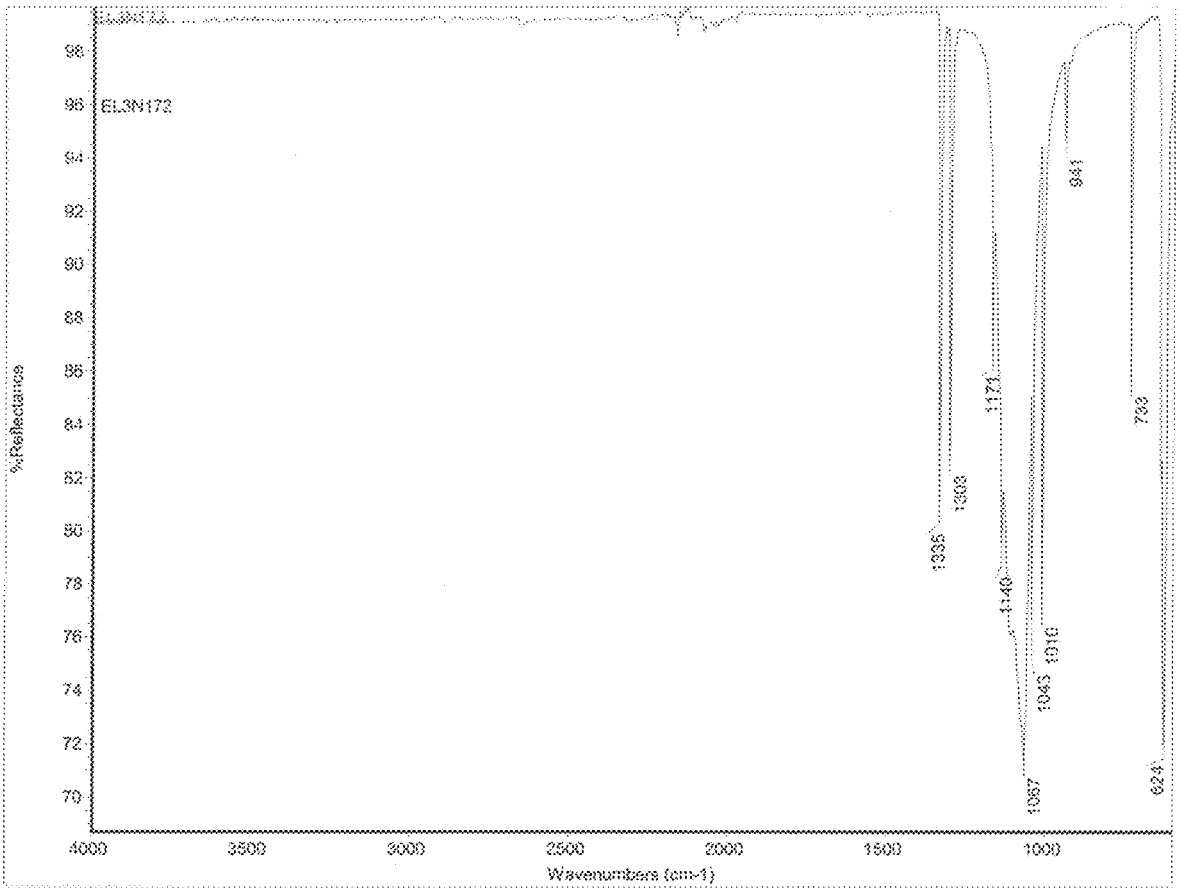
FIG. 2 shows the results of a Fourier Transform Infrared Spectroscopy ("FTIR") analysis on a material prepared according to the present techniques.

In the present application, $K_2Tz_2$ was prepared from commercially available diammonium 5,5'-bistetrazole (CAS 3021-02-1) and co-precipitated with potassium perchlorate by dissolving both materials in water at 85° C. and then pouring the solution into cooled (4° C.) 2-propanol (IPA). The resulting white solid was filtered, rinsed with IPA and air dried. FIG. 1 is a DSC spectrum acquired on a TA Instruments Q20 instrument with a ramp rate of 20° C./min to 500° C. and utilizing a hermetic aluminum pan. FIG. 2 is an FTIR spectrum obtained on a Thermo Scientific Nicolet iZ10 ATR instrument.

As illustrated in FIG. 1, DSC of the blended material afforded an endotherm at 310° C. (KP phase transition—orthorhombic to face centered cubic) and subsequent exotherm onset starting at 436° C. (473° C. peak). The exotherm at 436° C. corresponds to a temperature of approximately 820° F. and the co-precipitated material has been given the informal name BI-820. TGA experiments indicate that the first indication of weight loss in ZPP (355° C.) precedes that of BI-820 (361° C.), suggesting high thermal stability for BI-820.

In preliminary testing, it was determined that BI-820, when pressed into low energy EED units (such as hot wire units) commonly containing ZPP, underwent ignition under both constant current or capacitor discharge conditions and may be used to ignite a variety of next-in-line energetic materials including standard pyrotechnics (A1A, $BKNO_3$) and primary explosives (lead azide). In addition, the combustion products of BI-820 include four moles of nitrogen and so BI-820 may be ignited rapidly to produce gas for ballistic purposes. Under typical conditions BI-820 will maintain much better post ignition pressure after the initial peak compared to ZPP, where the pressure decays rapidly after peak due to cooling of the combustion residues.

Of primary importance however is that BI-820 is electrically non-conductive and is far less susceptible to unintended ESD ignition in EED devices compared to electrically conductive pyrotechnics containing metal fuels such as ZPP. Likewise, BI-820 would provide high post-ignition resistance after functioning. This may indicate that use of BI-820 in EED's would simplify the design of many of these devices both from safety and functional standpoints and result in lower costs during manufacture and usage of these items.

Further advantages of BI-820 use in EED's include extremely low cost and relatively non-toxic reactants used in production, ease of scale-up to production levels and, most importantly, greatly reduced stray ESD related safety concerns during manufacture. In addition, BI-820 produces non-corrosive combustion products. Testing of BI-820 is currently underway but it has been contemplated that the high ignition temperature of BI-820, in excess of 400° C., may be favorable regarding no-fire requirements for EED's.

It will be understood that BI-820 may be prepared by reacting any suitable 5,5'-bistetrazole salt with appropriate water solubility. Suitable bistetrazole salts may include, but are not limited to, alkali or alkaline earth metals or simple organic bases such as guanidine, aminoguanidine or triaminoguanidine.

Likewise, any suitable perchlorate salt may be employed. Suitable perchlorate salts include, but are not limited to, alkali or alkaline earth metals or simple organic bases such as guanidine, aminoguanidine or triaminoguanidine.

In the examples that follow, potassium salts were used, as those salts are typically anhydrous. It is anticipated that the cesium and rubidium salts would be anhydrous as well. The anhydrous lithium, sodium, calcium and magnesium salts of 5,5'-bistetrazole and perchlorate would be applicable as well; however, these salts are more likely to exist as hydrates. Other appropriate salts would include barium or strontium, but these may be considered less favorable based simply on toxicity or cost. The thermal stability of each of these salts is likely in the range that would make them relevant for low energy EED applications, such as hot wire applications.

In certain embodiments, the salts of bistetrazole and perchlorate are the same salts. In other embodiments, the salts of bistetrazole and perchlorate may be different salts.

Any suitable solvent or combination of solvents may be used. Suitable solvents include, but are not limited to, water.

Likewise, any suitable non-solvent may be used. Suitable non-solvents may include, but are not limited to, 2-propanol or any solvent that is water miscible so as to avoid the formation of more than one layer. Examples include 1-propanol, THF, and dioxane, among others.

Regarding quantities of the components employed, a 5,5'-bistetrazole salt may be supplied in a molar ratio of at least 0.8 mole per mole of perchlorate salt, of about 0.8 to about 1.4 mole per mole of perchlorate salt, of about 0.8 to about 1.3 mole per mole of perchlorate salt, of about 0.8 to about 1.2 mole per mole of perchlorate salt, of about 0.8 to about 1.1 mole per mole of perchlorate salt, of about 0.8 to about 1.0 mole per mole of perchlorate salt, at least 0.9 mole per mole of perchlorate salt, of about 0.9 to about 1.4 mole per mole of perchlorate salt, of about 0.9 to about 1.3 mole per mole of perchlorate salt, of about 0.9 to about 1.2 mole per mole of perchlorate salt, of about 0.9 to about 1.1 mole per mole of perchlorate salt, of about 0.9 to about 1.0 mole per mole of perchlorate salt, at least 1.0 mole per mole of perchlorate salt, of about 1.0 to about 1.4 mole per mole of perchlorate salt, of about 1.0 to about 1.3 mole per mole of perchlorate salt, of about 1.0 to about 1.2 mole per mole of perchlorate salt, of about 1.0 to about 1.1 mole per mole of perchlorate salt. In certain embodiments, a 5,5'-bitetrazole salt will be supplied in a molar ratio of 1 mole per mole of perchlorate salt or at a 60.5:39.5% ratio on a per weight basis.

The mixture may be heated to any suitable temperature that allows the salts to fully dissolve. In some embodiments, the mixture may be heated to a temperature of at least 50° C., or to a temperature of at least 75° C. In some embodiments, the mixture may be heated to a temperature ranging from about 50° C. to about 100° C.

A solvent may be supplied in an amount that is suitable to fully dissolve the mixture of 5,5'-bistetrazole salt and perchlorate salt. As a more specific example, water (or other solvent) may be supplied in an amount that is suitable to fully dissolve the starting materials. Ideally a minimum amount of solvent will be used at elevated temperature to maximize product recovery. Similarly, the non-solvent may be supplied in an amount that is suitable to fully precipitate the product. As a more specific example, 2-propanol (or other solvent) may be supplied in an amount that is suitable to fully precipitate the product. Ideally an appropriate amount of non-solvent will be used at reduced temperature to maximize product recovery.

The product contemplated and made by the methods of the present application (BI-820) may be found suitable for use as a pyrotechnic mixture and, in particular, as an ignition material in EED devices. Benefits include straightforward and ESD safe preparation with thermal stability required for high temperature applications.

EXAMPLES

The following examples demonstrate the preparation and characterization of BI-820 as taught herein.

Example 1—Dipotassium 5,5'-bistetrazole ($K_2Tz_2$)

Diammonium 5,5'-bistetrazole (79.0 g, 0.459 mol) was dissolved in 180 mL of deionized water in a 1 L beaker with an oval magnetic stir bar. Potassium hydroxide solution (45% w/w, 175 mL) was diluted to 800 mL with deionized water to provide a 10% solution. The diammonium 5,5'-bistetrazole solution was stirred at ambient temperature while the potassium hydroxide solution was slowly added with pH monitoring. When the pH was in excess of 12.0 (12.3, 560 mL 10% KOH) the addition was suspended and the clear, colorless solution was stirred for an additional 10 minutes. The total aqueous solution volume was ~850 mL and was divided into two portions of ~425 mL each. One portion was transferred to a 4 L flask and 3 L of 2-propanol were added to induce precipitation. The white suspension was stirred at ambient temperature for 10 minutes and then allowed to settle before filtering over Whatman #1 filter paper. The white precipitate ($K_2Tz_2$) was rinsed with 500 mL of 2-propanol. This precipitation process was then repeated with the other portion (~425 mL) of the solution. The precipitates were combined and allowed to air dry. Yield for the process was 101 grams (83%).

Example 2—Co-Precipitation of $K_2Tz_2$/KP (BI-820)

A 1 L beaker was charged with $K_2Tz_2$ (39 grams, 0.182 mol), potassium perchlorate (25.5 grams, 0.183 mol) and 375 mL of deionized water. The mixture was stirred with heating (76-85° C.) to fully dissolve the solids. A 5 L spherical jacketed glass reactor was charged with 3.5 L of 2-propanol and the 2-propanol was cooled to 4° C. with stirring at 375 RPM. The warm $K_2Tz_2$/KP/water mixture was transferred into the cold 2-propanol over 15 seconds and a white precipitate formed. During the addition the temperature of the reaction mixture increased to 12° C. and was allowed to cool back to 4° C. with stirring. The precipitated product (BI-820) was collected on Whatman #1 filter paper, rinsed twice with 2-propanol and allowed to air dry. Yield for the process was 49 grams (76%).

Analytical methods were developed to confirm the ratio of $K_2Tz_2$ and KP in the BI-820 formulation. The BI-820 was dissolved in water and appropriately diluted. The 5,5'-bistetrazole concentration was evaluated via reverse phase HPLC methods on an Agilent 1100 system equipped with a DAD. A C18 column was utilized with a 30 mM aq. MSA/$CH_3CN$ 92:8 mobile phase at 1 mL/min and detection at 235 nm. An external standard calibration curve was prepared over the concentration range of interest for direct determination of the 5,5'-bistetrazole content. The perchlorate content was evaluated via IC methods on a Thermo Scientific ICS-5000 equipped with a AS20 column and an ARES500, 4 mm suppressor. IC conditions included a 10 mM KOH aq. mobile phase at 1.1 mL/min with 58 mA suppression. Results were compared to a calibration curve prepared over a suitable concentration range. Standard recoveries drifted so it was necessary to run the calibration and sample concurrently. Analysis of the above prepared BI-820 lot produced results consistent with a 1:1 molar ratio of $K_2Tz_2$ and KP (60.7%:41.3% assay values—60.5:39.5 theoretical).

Preliminary safety testing on BI-820 included friction, impact, ESD and calorifics tests and are reported below relative to a commonly used ZPP mixture.

| | BI-820 | ZPP |
|---|---|---|
| Friction | >2075 g - No Fire (6) | >2075 g - No Fire (6) |
| Impact | 85 cm - No Fire (10)<br>90 cm - Fire<br>(RDX 50 cm) | 80 cm - No Fire (10)<br>85 cm - Fire<br>(RDX 50 cm) |
| ESD Sensitivity (LEESA) | >7.43 mJ (1650 pf/3 kV) above tester limits | 33 μJ - No Fire (1650 pf/200 V)<br>51.6 - μJ Fire (1650 pf/250 V) |
| Calorific data ($\Delta H_{explo}$) | 900 cal/gram | 1200 cal/gram |

Friction sensitivity test were performed in a small scale Julius Peters BAM tester. Maximum load weight was 2075 grams. The no-fire level was determined by six successive tests where there was no indication of ignition.

Impact sensitivity tests were performed on an instrument complying to UN Test Manual Test 3(a)(iv) modified Bureau of Mines impact machine specifications with a 2.0 kg drop mass.

ESD data were obtained on a Low Energy Electrostatic sensitivity apparatus (LEESA). See Carlson, R. S. and Wood, R. L., "Development and application of LEESA (low energy electrostatic sensitivity apparatus)". Technical report, EG and G Mound Applied Technologies, Miamisburg, OH (USA), 1990.

Heat of explosion measurements were made on duplicate BI-820 samples utilizing a Parr 6200 bomb calorimeter equipped with a Parr 1108 oxygen bomb.

BI-820 has been determined to be fully compatible with the boron nitride used in charge holders and other energetic materials. These tests are currently on-going.

Comparison of Co-Precipitated and Mechanically-Mixed BI-820 Samples

Comparison of co-precipitated and mechanically-mixed BI-820 samples were made by evaluating the particle size distribution of samples prepared from identical reactants. The potassium perchlorate used in the mixtures was hammer milled to approximately 15 micron particle size, which is equivalent to that typically used in ZPP. The same lot of $K_2Tz_2$ was used for both preparations and was synthesized using the method of Example 1. The ratio of reactants by weight was identical for both mixtures.

A dry 20 gram sample of BI-820 was prepared on a Resodyn LabRAM Resonant Acoustic Mixer (RAM) by passing the reactants through a 20 mesh (864 micron) screen and adding to a velostat container. The salts were blended in the velostat container by applying a 35 G acceleration for one minute followed by a 50 G acceleration for 3 minutes. The product BI-820 was isolated as a white powder and exhibited no evidence of static charge buildup on blending.

The particle size distribution was determined utilizing a MicroTrac S3500 light scattering particle size analyzer under 2-propanol (IPA) carrier. Samples were initially run without sonication and then run a second time after exposure to sonication at 25 W for 60 seconds.

Distribution data for both BI-820 prepared via co-precipitation (Example 2) and by the physical mixing procedure described are distinctive. The co-precipitated sample demonstrates a continuous range of particle sizes from 3-500 micron initially with a mean volume diameter ("MV') of 82 micron. Upon sonication, the distribution tightens substantially and has a 3-30 micron range with a MV of 15 micron and with minor submicron material present, indicating that the co-precipitated BI-820 is likely agglomerates.

In some cases, the particle size distribution of the co-precipitated BI-820 after sonication may range between 1-60 micron, may further range between 1-50 micron, may further range between 1-40 micron, and may further range between 1-30 micron.

In some cases, the MV of the co-precipitated BI-820 after sonication after sonication may be less than 50 micron, may further be less than 40 micron, may further be less than 30 micron, and may further be less than 20 micron.

The BI-820 sample prepared by physical mixing on the LabRAM exhibits a much larger bimodal distribution with the bulk of the material having a particle size centered around 20 micron, but with a substantial portion of the sample have a particle size in the 400 micron range (MV 109 micron) prior to sonication. With sonication, the physical mixtures mean volume diameter decreases slightly to 83 micron with a major component in the 10 micron range, but the sample still contains a high percentage of particles in the 300 micron range. This would indicate that the physical mixture is not composed of agglomerates, as is the co-precipitated product, but of discrete crystals of smaller and larger particle sizes that are not as susceptible to sonication. Additionally, the physical mixtures' mean particle size is much greater. It is anticipated that the co-precipitated BI-820 product is substantially more homogeneous than that of the physical mixture.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A non-electrically conductive energetic composition, wherein the composition generates heat and sparks to ignite an explosive, wherein the composition has an ignition temperature in excess of 400° C., wherein the composition comprises dipotassium 5,5'-bistetrazole, boron nitride, and potassium perchlorate, and wherein the molar ratio of dipotassium 5,5'-bistetrazole to potassium perchlorate is from 0.8:1 to 1.4:1.

2. The energetic-composition of claim 1, wherein a particle size distribution of the dipotassium 5,5'-bistetrazole and potassium perchlorate ranges between 1-50 micron.

3. The energetic-composition of claim 1, wherein the dipotassium 5,5'-bistetrazole and potassium perchlorate comprises a mean volume diameter of less than 30 micron.

4. The energetic composition of claim 1, wherein the dipotassium 5,5'-bistetrazole is at 1 mole per mole of the potassium perchlorate.

5. A low energy electro-explosive device comprising, the device comprising:

an ignition element; and an acceptor surrounding at least a portion of the ignition element, wherein the acceptor is non-electrically conductive and comprises a composition that generates heat and sparks to ignite the device, wherein the composition has an ignition temperature in excess of 400° C., wherein the composition comprises dipotassium 5,5'-bistetrazole, boron nitride, and potassium perchlorate, and wherein the molar ratio of dipotassium 5,5'-bistetrazole to potassium perchlorate is from 0.8:1 to 1.4:1.

6. The low energy electro-explosive device of claim 5, wherein the ignition element is a bridgewire, a thin film bridge, a semiconductor bridge, or a reactive semiconductor bridge.

7. The low energy electro-explosive device of claim 5, wherein dipotassium 5,5'-bistetrazole and potassium perchlorate is a co-precipitated product.

8. The low energy electro-explosive device of claim 5, wherein a particle size distribution of the dipotassium 5,5'-bistetrazole and the potassium perchlorate ranges between 1-50 micron.

9. The low energy electro-explosive device of claim 7, wherein the dipotassium 5,5'-bistetrazole and the potassium perchlorate comprise a mean volume diameter of less than 30 micron.

10. The low energy electro-explosive device of claim 5, wherein the dipotassium 5,5'-bistetrazole is 1 mole per mole of potassium perchlorate.

* * * * *